United States Patent [19]

Cox

[11] 3,962,838

[45]*June 15, 1976

[54] SHELF-ADJUSTING STAIR

[76] Inventor: Joe Warren Cox, 504 Rancho Road, Thousand Oaks, Calif. 91360

[ * ] Notice: The portion of the term of this patent subsequent to May 27, 1992, has been disclaimed.

[22] Filed: Mar. 14, 1975

[21] Appl. No.: 558,485

[52] U.S. Cl. ..... 52/183; 52/633; 182/1

[51] Int. Cl.[2] ..... E04F 11/00; E04F 19/00

[58] Field of Search ..... 182/1; 52/182, 183, 52/184, 633, 645, 646

[56] References Cited

UNITED STATES PATENTS

| | | | |
|---|---|---|---|
| 1,189,514 | 7/1916 | Wallace | 182/1 |
| 3,123,185 | 3/1964 | Van Der Rijst | 52/633 |
| 3,367,444 | 2/1968 | Meddick | 182/1 |

*Primary Examiner*—Ernest R. Purser
*Assistant Examiner*—William Randolph
*Attorney, Agent, or Firm*—Jack C. Munro

[57] ABSTRACT

A self-adjustable stair construction wherein the treads of the stair are supported by spacers between parallel upper and lower stringers in a truss assemblage. The rise and run and nosing are simultaneously adjusted for each tread with the adjustments being cumulative for each stair flight total run while maintaining the treads level. Each tread is located in a right angle relationship with each spacer. The treads, spacers and stringers are pivotally connected together with an elongated slot formed in each spacer to permit the adjusting movement. The slots are inclined and may be either curved or straight with the slope of either being in substantial alignment with the direction of the adjusting movement. The minimum number of repeated parts to produce the whole stair may be two.

15 Claims, 12 Drawing Figures

SHELF-ADJUSTING STAIR

BACKGROUND OF THE INVENTION

The structure of this patent application is an improvement of the structure defined within U.S. patent application Ser. No. 476,873, filed June 6, 1974 now U.S. Pat. No. 3,885,365, patented May 27, 1975.

The design of stairways is dependent on several factors and requires complying with minimum dimensional safety standards of the various existing building codes. Example: The rise (abbreviated $r$) shall not exceed 7½ inches in commercial buildings or eight inches in houses and the net tread or run (abbreviated $t$) shall not be less than 10 inches in commercial buildings or nine inches in houses. Some codes require a minimum nosing depth when the run is less than a specified limit. The maximum variations in the rise and run in any one flight is one-quarter of an inch. Thus, the codes attempt to regulate accuracy of construction, but recognize that it is nearly impossible to achieve equal variation of all constructed parts in any one flight. All stairs previously constructed, with the exception of the stair of the aforesaid patent application, exhibit some defect in trying to achieve this accuracy of uniform variation.

Stair design has historically relied on various, and different empirical rules of thumb equivocal building safety codes, and industry standards. The "best" rule was a matter of opinion and the individual designers usually resorted to code values close to the minimum tread and the maximum riser to save stairwell space. Recent scientific studies for the first time based on extensive "user" testing for both comfort (lowest rate of user energy expenditure during ascent) and safety (the fewest user missteps occuring during descent regardless of speed) has disclosed that standardization may now be possible and recommended with regard to riser height and tread depth and their proportions to each other.

Actual testing for comfort has revealed that the rate of user energy expenditure is always higher for higher risers unless these higher risers are combined with a corresponding reduction in the net depth of the treads at which time thhe user comfort approaches the lowest uniform energy rate. Also, stairs with nosings are more accommodating than without nosings because more toe and heel space depth is made available beyond the net tread depth.

Since the average anthoropometric requirements of the user do not change, there is no reason why the use should be unduly subjected to unsafe, uncomfortable and different stairs. The user should not have to shift his gait between the upstairs and the basement in his own house, or when he goes outside, or goes to work in public areas, or encounters industrial stair work situations. Rules can now be derived for comfort or safety or both in equations and pre-scheduled form with confidence.

Presently a rise ($r$) of 7½ inches maximum, combined with a run ($t$) of 10 inches minimum will satisfy seven different published codes and standards. The accompanying dissimilar proportional comfort rules in some of these codes and standards (not not all) are $2r + t = 25$ inches; $r + t = 17.5$ inches; $r \times t = 75$ inches; $4r + 3t = 60$ inches and $2r + 3t = 45$ inches which can all be satisfied by $r = 7½$ inches and $t = 10$ inches. Some of these rules waste total run space needlessly while other rules are so blatantly equivocal that most codes grant exceptions to their own rules by making trivial distinctions between public and private uses of stairs.

The convention for constructing stairs is for an architect or other designer to make detailed design drawings, then require by specification that separate, more fabrication drawings be made by the fabricator and returned for the designer's approval. The fabrication drawings should take into account variable field conditions as much as possible, but this is seldom done in practice. Approved fabrication drawings are used for shop fabrication of the stairs. The stair built then becomes a rigid framework for field erection. Unfortunately there are variations in the stairwell space provided for its installation or erection. Only during installation can the errors of stair design in relation to the stairwell space it is suppose to fit be assessed and corrected. Often, several different trades are required to cooperate with each other to complete the installation over a long period of time. It is also common for stair risers or treads to be shortened or extended at the landings just to make the stair fit. Sometimes landings have to be field modified because the rigidly constructed stair is too difficult to correct.

Previous to this invention and the invention of the aforementioned patent application, custom stairs were fabricated from all manner of manufactured stock materials such as rolled steel shapes, bent plates, welded metal plates, and various kinds of fasteners of different sizes. These stock materials had to be reworked extensively by operations such as cutting, piecing, fitting and extensive welding in order to produce a custom design.

Previous to this invention and the invention of the aforesaid patent application, field violations of the code limits were often overlooked or avoided by inspectors because to construct the stair precisely in accordance with the approved drawings was normally just not expected. It is a rare occurrence to have the run and the rise within each stair flight exactly equal or to have one flight match the next flight.

SUMMARY OF THE INVENTION

This stair invention, as well as the invention defined in the aforesaid patent application, strives for design standardization and simplification in the producer industry for the benefit of the human user in a total, comprehensive way. This stair invention can exceed guidelines developed from scientific human user tests for safety and comfort. It is especially suitable for "performance" type specifications and is intended to become an off-the-shelf component structure offered for "systems building" besides its other conventional uses. Both safety and comfort will be maintained because this invention can establish its linkage dimensions and geometry based on any of the preferred standards and made adjustable so as to maintain or exceed those standards throughout its proportional adjusting movement. Each stair stringer is a kinetic truss with three repeated linkage parts. The three articulated linkage parts are pin-connected, and a slot located in the vertical tread spacer permits the linkage to generate self-adjustment following the principle of a jig. Its changing space geometry and strength are pre-supposed and therefore can be incorporated into a pre-calculated schedule for a selected rule. In but a few seconds the specifier chooses from a selection of riser heights to compare with the required total rise, then the total number of resulting treads and the resulting total run. Also scheduled are the net tread and net nosing which are the geometric result of the unit rise selected. If a mistake is made in the stairwell space estimate, platform construction or installation procedure, this stair invention will adjust to these errors.

This stair invention utilizes the same size treads and risers for different rules in which each self-adjust simultaneously and cumulatively to fit either the total rise or total run, and does so in accordance with a selected comfort proportional rule.

The proportional comfort rule is: as the unit rise ($r$) increases, the net tread depth ($t$) decreases, and the net nosing depth ($n$) should increase, and vice versa. Examples of how this rule is derived and operates is shown in the drawing Figures and description. During the converse adjustment, the space for the user's feet is always preserved because as the net tread increases, the nosing distance decreases so that the sum of the net tread plus the nosing depth is alway a constant therefore standardizing the tread depth dimension. So, therefore, the stair of this invention inherently achieves comfort because a preferred proportional ratio is automatically maintained between the run and rise and the nosing sacrifices its net dimension to standardize the tread depth. It all depends on how much total run space is to be sacrificed at the expense of the users' safety and comfort without wasting total run stairwell space.

This stair invention readily accommodates all dimensional variations between landing constructions such as vertical and horizontal variance. This stair is designed to be prefabricated, or may be partially assembled at any time from parts before, during, or after building construction. It is demountable and can be relocated and re-adjusted in a new location. This stair may be fitted with standard size treads which can be replaced, reversed, or new treads may be substituted. Standardized options include: an open or closed riser, integral or separate balusters, and zero-waste crating for shipping.

Since the adjustment is continuous, this stair is less affected by impending metrication. Only a few standardized parts are required so that the lowest possible cost is incurred to specify or design, manufacture, inventory, fabricate, freight, install, inspect, maintain, re-use, or salvage this stair invention.

The articulates sructure of this invention has only three different parts which are repeated to produce a whole stair. However, the minimum number of repeated parts may be reduced to two if the tread, tread carriers, and tread spacers (or their integral extension into balusters) are not articulated but are unitized into a one-piece step for first part. The second part is the stringers which may also repeat as a handrail or handrail fitting.

The articulated structure of this invention will be described by the relative movements of the parts used on one lateral side of the stair since both sides are identical. for purposes of description, the stair framework parts will be discussed in relation to the horizontal and vertical directions of the stair in its normally installed position (front or forward is horizontally toward lower landing and rear is horizontally toward the upper landing which shall be called depth).

Upper and lower stringers form a simple parallelogram linkage with pivot points at each tread. Mounted to the stringers are the horizontal tread carriers and the vertial tread spacers. Each tread spacer has a slot in one end which cooperates through a connecting pin to provide adjustment. The slot is at an angle with respect to the longitudinal axis of the spacer, the angle of the slot being in substantial alignment with the direction of the adjusting movement. Each end of the tread spacers is pinned to a stringer which spaces the treads the same distance apart and keeps them parallel to the succeeding tread. The stringers are positioned in a parallel relationship and are maintained that way throughout the adjustment because each end of the horizontal tread carriers is pinned to the stringers. The tread spacer is maintained substantially at a right angle to the tread carrier.

The lateral side of the stair is a truss. The truss components are the stringer, tread carrier and the tread spacer, all of which comprise a linkage. The slot in the tread spacer, which provides the adjusting movement, is located at one junction of the truss linkage. The treads themselves serve to laterally space the stringers apart, prevent side sway, and to transfer the same adjustment to each lateral side.

The stair of this invention has advantages in addition to the advantages previously enumerated in the aforementioned patent application. The primary additional advantages are: (1) The minimum number of articulated repeated parts has been reduced. (2) There are fewer combinations in the side by side junctions of the stringer and the tread spacer. (3) Manufacturing costs are significantly lessened. (4) Assembly is easier. (5) Dead weight is slightly reduced and less material is required. (6) The motivating force to produce the adjusting movement is less and more obvious to the workman because it is localized in just one slot and is directed substantially in alignment with slot. A push or pull normal to the stringers will produce the adjustment. (7) There is continuous closure between the inclined lip of the closed riser pan and the adjacent complimentary inclined nosing piece of the succeeding tread in which they are substantially parallel to each other and both are also in the direction of the adjusting movement.

DETAILED DESCRIPTION OF THE SHOWN EMBODIMENT

Figures 1A, 1B, 1C, 1D, 2, 3A, 4, 5:
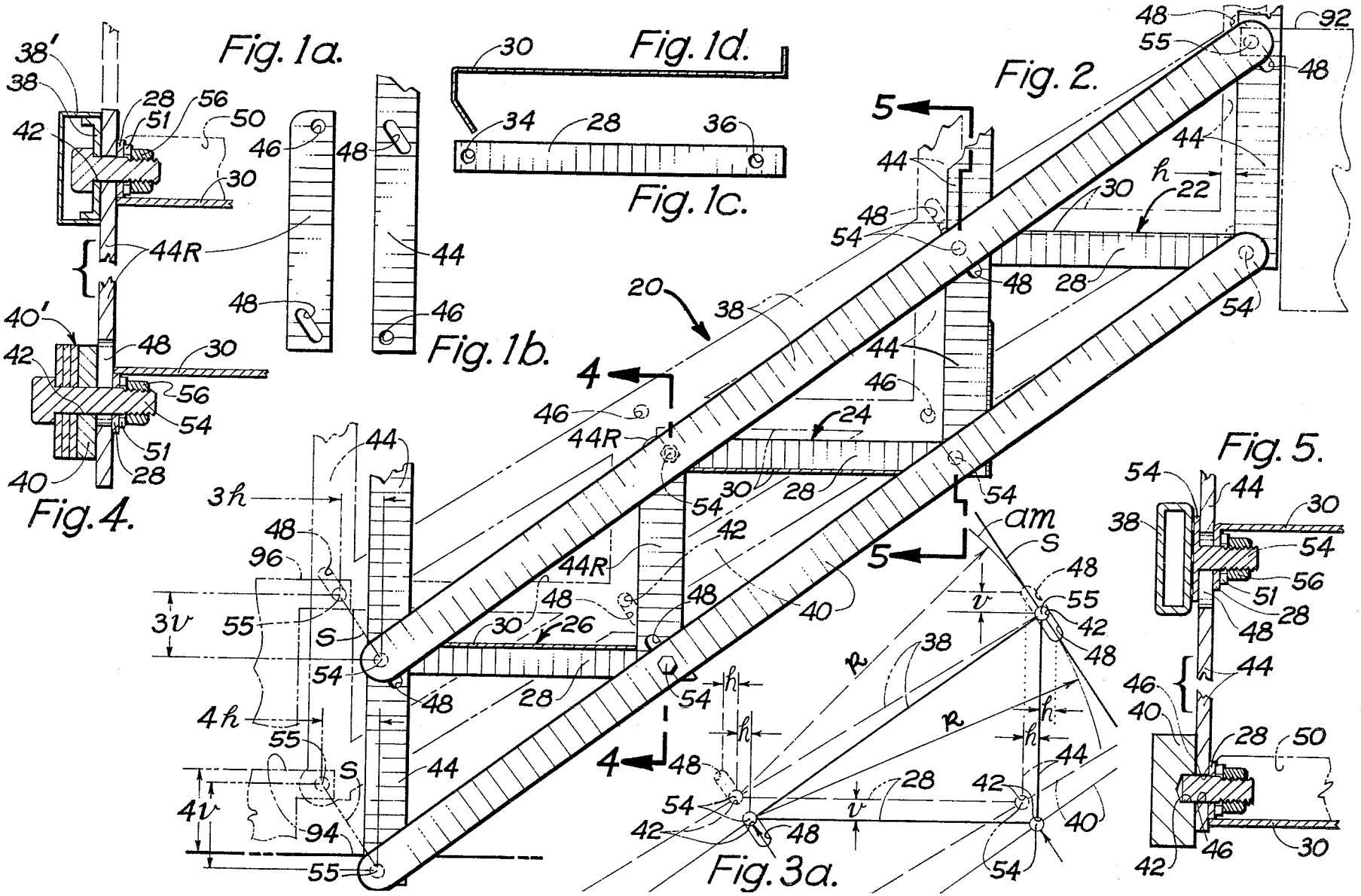
FIGS. 1*a* through 1*d* are views of the members employed within this invention without the stringers and the member of FIG. 1*a* is the same member of FIG. 1*b* but in reverse.
FIG. 2 is an elevational side view of this invention indicating the member relationships with a phantom view where the rise is a minimum.
FIG. 3*a* is a schematic diagram to show clearly the adjusting movement with numbered points which relate to member parts in FIG. 2 or FIGS. 6*a* and 6*b;*
FIG. 4 is a cross-sectional view taken through line 4—4 of FIG. 2.
FIG. 5 is a cross-sectional view taken through line 5—5 of FIG. 2.

Referring in particular to the drawings, there is shown the stair 20 of this invention basically composed of three different steps 22, 24 and 26. Each articulated step is composed basically of a pair of horizontal tread carriers 28 supporting a tread 30 with an optional closed riser 32, and a pair of vertical tread spacers 44 or 44R. The closed riser 32 may be eliminated if desired to achieve an open area between adjacent treads or it may be connected to either the tread 30 or tread spacer 44 or 44R or both. Although there are only three steps shown in the drawings, it is to be understood that top step 22 occurs at the top landing connection and the middle step 24 occurs any number of repeated times between 22 and bottom step 26. Steps 22, 24 and 26 may be composed of the same parts.

The tread carriers 28 are opposed, one on either side and each comprise a flat metal link placed on edge. The tread carrier 28 will always be positioned horizontally.

Two tread carriers 28 support the tread 30. The tread 30 will normally be formed of a sheet metal material as the finished part or as a substrate for other cementitious filler materials 50. The tread 30 can be made integral with the tread carriers 28 or comprise two separate parts as shown in FIGS. 1c and 1d.

Adjacent to the front of each of the tread carriers 28 is formed therein a hole 34. At the rear of each of the tread carriers 28 is a hole 36. The holes 34 and 36 cooperate with bolts 54 to connect together the parts of the stair 20 of this invention.

Located on each side of the stair 20 is a pair of upper stringers 38 and lower stringers 40 which are identical to each other and are comprised of elongated flat rigid members, usually formed out of metal, and include a plurality of holes 42 formed therein equally spaced apart. The stringers 38 and 40 on both sides of the stair are positioned in a parallel relationship and spaced several inches apart.

Figures 3B, 6A, 6B, 7:
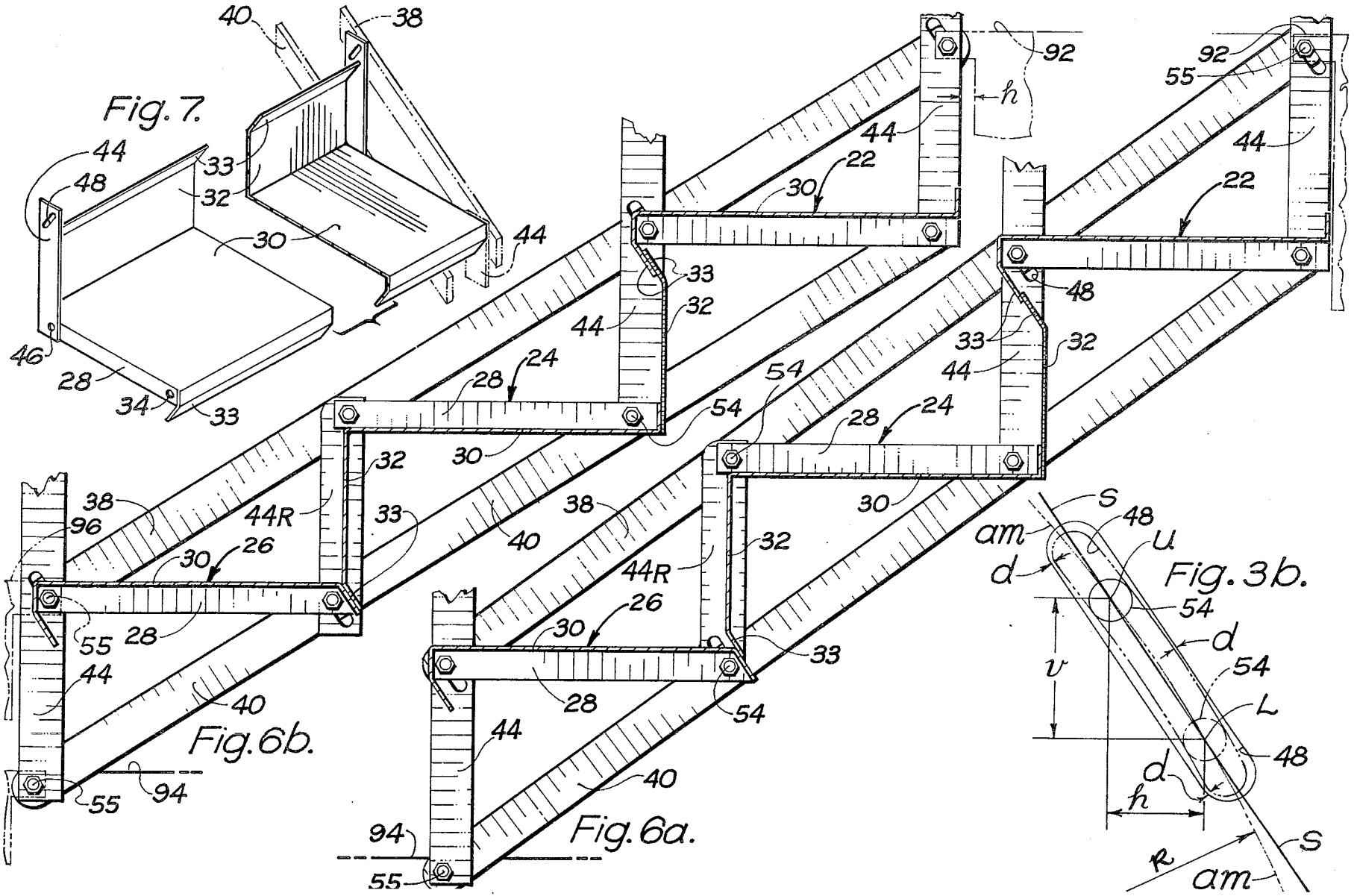
FIG. 3*b* is an enlarged elevational view of an oversize straight slot outside a curved slot following the path of the adjusting movement.
FIG. 6*a* is a cross-sectional view of the first embodiment of the stair depicting the change in the net tread and rise relationship and nosing depth in the lower position where rise is a maximum and the net tread is a minimum; and the nosing depth is a maximum.
FIG. 6*b* depicts the upper position where the rise is a minimum and the net tread is a maximum and the nosing is a minimum.
FIG. 7 depicts all the articulated parts related to one step unitized to form a rigid, one-piece step out of a single stamped and bent piece of flat sheet metal.

Interconnecting each of the stringers 38 and 40 are a plurality of vertical tread spacers 44. The vertical tread spacers 44 are maintained substantially in a vertical relationship during the adjustment movement. Each of the vertical tread spacers 44 are formed in the shape of a flat, rigid link and include hole 46 adjacent to one end and an elongated straight slot 48 at the other end. Actually, from one adjustment position to the other, a slight negligible inclination occurs in the tread spacer 44, but the inclination stays very close to and sometimes is vertical. If slot 48 is a curved slot, instead of a straight slot, with a large radius "R" shown in FIG. 3*a*, where the origin is located at and is equal to the uniform distance between holes 42 in the stringers 38 and 40, no inclination at all will occur in vertical tread spacer 44 or 44R and the angle between the vertical tread spacer 44 or 44R and the tread carrier 28 is fixed at a right angle exactly. Referring to FIG. 3*b*, although either a curved slot or a straight slot (preferred) may be chosen for slot 48, it is necessary to understand that the exact relationship between the two may be analyzed and compared using algebra. The straight slot centerline "S" is represented by a linear equation and the curved slot centerline "am" is represented by an equation of a circle. The centerlines of either may be derived with respect to the other with three possible results. First, the straight line may come close but not intersect the curved line. Second, the straight line may be tangent to the curved line. Third, the straight line may intersect the curved line at two points. The third result has the advantage of minimizing the maximum variation called deviation "*d*" between the straight line "S" and the curved line "am" throughout a longer duration of adjustment "*v*". The third result is depicted in FIG. 3*b* as only one practical example and hereinafter is described as follows: Let the desired rise "*r*" = 7½ inches (at upper point "U") and the run "*t*" = 10 inches. This will establish radius "R" = 12.5 inches because tread carrier 28 and tread spacer 44 are to be held in a right angle relationship. This establishes an equation for the centerline of the curved slot of $r^2 + t^2 = (12.5 \text{ inches})^2 = 156.25$. Next, vertical adjustment "*v*" of 1⅛ inch is selected for amount of adjustment desired less than $r = 7.5$ inches which is $r = 6\frac{3}{8}$ inches (at point "L"). A straight line "S" is drawn between these two points after they are made to intersect the curved centerline "*am*" to create an arc with two end points. Next an equation is derived for the straight line with a slope "*S*" of $2r + 3t = 45$ because the slope is three vertical to two horizontal and is algebraically simultaneous with "am" at the two points of intersection. The slope "S" becomes the angle of straight slot 48 and in this example three "*h*" = *two* "*v*" to permit the adjusting movement to occur. A different intersection or "R" value will produce a different slope for straight slot 48. In this example, the maximum deviation "*d*" between the straight line "S" and the curved line "*am*" approaches a straight line and within the arc is found to a maximum of 1/64 of an inch. However, "*r*" could also be reduced to a new limit beyond the lower end point "L" to 6 inches (where "*d*" = 1/32 inch) or increased beyond the opposite upper end point "U" to new limit of 8 inches (where "*d*" = 1/16 inch) with a resulting slightly greater increase in deviation "*d*". It is expected that the actual desired range of adjustment "*v*" would be selected much less than 2 inches or even 1⅛ inches (FIG. 3*a* illustrates "*v*" = ¾inches for example). There is no need to select "*v*" greater than necessary but it is obvious that a straight oversized slot has an eventual upper and lower limit depending on the slope of the line "*S*" in relation to the length of "R".

The values for "*h*" and "*v*" may be only a matter of fractions of an inch since it is desired to keep the length of the slots 48 as short as possible so that when all the pins are fastened, the slots are concealed from view. However, larger values for "*h*" and "*v*" does allow the same stair design to fit a greater extent of total rises. Because the adjustment is cumulative throughout the total run of the stair, the connected end of the stairway will be moving as much as several inches in the horizontal direction "*h*", but in this example the vertical movement "*v*" was proportioned greater to exceed the horizontal movement to conserve stairwell space. For example, "*h*" *was selected equal to two-thirds* "*v*". A selected slope "S" relative to the position of a straight slot 48 shall be and is in substantial alignment to the curved path of the adjusting movement "*am*" so as to be able to both predict and set the limits of the adjusting movement. Therefore, it has been shown that it makes no substantial difference whether slot 48 is curved or straight but for one exception. That exception occurs when the selected limits of adjustment (including the slot width) of the slots are accidentally exceeded during the adjusting movement when tread carriers 28 are not articulated but are integrally fixed in a one-piece and precise right angle relationship to vertical tread spacer 44 having a straight slot 48. Then, bolts 54 would gradually begin to rub the slot width and be restrained by either side of straight slot 48 occurring beyond the limits of adjustment. But should a curved slot 48 be substituted instead of a straight slot 48 with all the conditions being the same as mentioned in the above exception, bolts 54 and 55 would continue moving unrestrained and be stopped only at each end of the curved slot 48. Referring again to stair 20, the connecting together the articulated components of the step which are the vertical tread spacers 44 and 44R, the tread carriers 28 and the treads 30 to the stringers 38 and 40 may be accomplished by means of conventional bolts 54 and nuts 56. The use of the bolts 54 and untightened nuts 56 permit the adjustment movement of the invention between the solid line position and the phantom line position shown in FIG. 2. Once the desired position is obtained, the nuts are then tightened to fix that position. The bolts are conducted through holes 42 of the stringers 38 or 40 and then through the appropriate aligned aperture within the tread carrier 28 which could either be hole 36 or hole 34. If desired, a means to fix or to pre-fix the desired position would be to substitute a hole, with the proportional bounds of slot 48, instead of the slot 48 let's say at either the landing connections 92, 94 or 96. This substitution, however, is not necessary or desirable unless there are overriding considerations to pre-fix the adjusting movement.

The vertical tread spacers 44 as well as the tread carriers 28 may be reversed and the same movement will result. This type of arrangement is shown in FIG. 2 wherein one of the vertical tread spacers 44 is reversed (shown as number 44R with respect to the remaining tread spacers. This is shown by the slot 48 being located adjacent the lower stringer 40 wherein the other slots 48 are located adjacent the upper stringer 38). Note FIG. 1A for a showing of the reversed tread spacer 44R.

In the assembling of the different parts, any assemblage procedure may be chosen to produce the desired relationship. For example, the different parts can be arranged side by side as shown in the examples of FIG. 4 and FIG. 5. FIG. 4 illustrates an upper stringer 38 which usually requires much less strength than does the lower stringer 40 in which a chanel member is formed to provide the primary minimum structural compression piece and then a channel cover piece 38' is added to cover the bolts and to add to its lateral strength. The upper stringer 38 in FIG. 5 is a tubular section which has an attached bolt 54 in the form of a standard weld screw "T" fastener which has been welded to upper stringer 38. The lower stringer 40 in FIG. 4 is a flat steel bar which is the primary structural tension member but has added to it in "shingle fashion" a series of additional stringers or shortened stringers or links 40' which may be added to stringer 40 to gradually increase strength or to increase strength only at points of maximum stress without accumulating dead weight for the entire length of primary stringer 40. In FIG. 5, lower stringer 40 has a standard stud welded to it after a location hole has been drilled. It is to be understood that all the stringers in FIGS. 4 or 5 could be interchangeable, depending on the desired end result. It is considered to be within the scope of this invention that the parts can be arranged in any particular desired manner. Normally, it is preferred that the parts be chosen and arranged per the particular installation and, it is desirable to arrange the parts to achieve ease of erection, installation, and for the best "finished" appearance.

Referring to FIG. 2, and FIG. 3*a*, the same adjustment movement for the treads of steps 22, 24, and 26 are depicted. Tread 22 is depicted with a stationary pivot bolt 55 cooperating with slot 48 and fixed to a landing. The maximum rise position is shown in solid lines with the minimum rise re-adjusted position in phantom lines in FIG. 2 and FIG. 3*a*.

In FIGS. 6*a* and 6*b* and also FIG. 2, as the stair is adjusted from the lower position to the upper postion, the bolts 55 and 54 in upper stringer 38, position, of resting againt the upper and forward end of the slots 48, will move to contact with the lower and rear ends of the slots 48. Thus, the bolts in cooperation with slots 48 will move from the forward side of the slot 48 to the rear side of slot 48. The resulting bolt movement produces a vertical movement denoted "*v*" and a horizontal movement denoted "*h*" in the tread. The slope defined by "*h*" and "*v*" has been shown to coincide with a selected proportion or ratio. The adjusting movement of each succeeding tread 30 is cumulative. So as a result, tread at step 22 moves "*h*" and "*v*" in relation to pivotal landing bolt 55 but at the same time the run moves forward of the landing 92 a distance "*h*" to be added to total run. Tread at step 24 moves 2*h* and 2*v*. Tread at 26 moves 3*h* and 3*v*. However, the lower stringer 40 has moved one additional "*h*" and "*v*" at land 94, bolt 55 to total 4*h* and 4*v* (shown in FIG. 2), wherein slot 48 is not located. Should it be desired to connect the stair where slot 48 is located say at lower landing 96 flush with tread 30 of step 26, then 3*h* and 3*v* would be the adjustment.

The stair 20 of this invention designed for the total rise or total run between landings automatically establishes the known physical dimensions in space for connecting it at the landings. It is common that there will be small dimensional errors between the space provided for the stair and the space the stair will occupy in the erected position. These errors can readily be compensated for by fixing either the top or the bottom end of the stair to its respective landing and then moving the opposite end of the stairway into connection with its respective landing.

An optional feature of the framework of this invention is that balusters which are used to connect and to support handrails can also be an integral extension of the framework parts. As shown particularly in FIG. 2, the vertical tread spacers may be extended in an upward direction to connect with a handrail similar to a lower or upper stringer (not shown) which will parallel the upper stringer and supports the handrail. Therefore, balusters can be incorporated and prefabricated along with the stair of this invention.

The stair of this invention may readily be used as a reusable forming structure (not shown) to produce a concrete stair in a similar manner to framework 58 of the aformentioned patent application described in two basic cases described below.

In the first case, referring to step 22 in FIGS. 6*a* and 6*b*, tread spacer 44 with slot 48 at the nosing, allows a rigid right angle relationship at the rear junction of tread carrier 28 below it and and the closed riser 32.

Closed riser 32 is divided into two pieces at inclined portions 33 which are at the same slope as slot 48 and are maintained closed during the adjusting movement to retain wet cement. The nosing portion is jointly attached to adjacent tread carriers 28 and the closed riser pan is secured to a pair of tread spacers 44.

In the second case, refering to step 24, the tread spacer 44R with slot 48 at the rear of the tread spacer 28, allows a rigid right angle relationship at the nosing above it. The closed riser pan 32 is one piece and extends upward, not necessarily vertical, forming any desired nosing profile at the tread level and is attached to tread carriers 28 or stringer space 44R or both.

In both cases cited, the cement rises to the level of treads 30 and thereby replaces treads 30. The closed riser pan may be left cast-in or removed at any time after the cement has sufficiently hardened. The lower free end of closed riser 32 is not attached to anything except tread spacer 44. In all other similar regards, the previously described functions of the aforementioned application relating to related parts below the line created by stringer 38 in FIG. 8 and stringer 40 in FIG. 12, would serve to avoid repeating here a similar description.

What is claimed is:

1. A self-adjusting stair framework formed of a plurality of interconnected linkage members, said framework comprising:

a plurality of treads positionable in a substantially horizontal relationship, each of said treads having a front side and a rear side and a pair of lateral sides, each of said treads supported by a pair of tread carriers, a said tread carrier located at each said lateral side of each of said treads;

a pair of upper stringers, each said upper stringer pivotally connected to said tread carriers;

a pair of lower stringers, each said lower stringer pivotally connected to said tread carriers;

a vertical tread spacer located between and pivotally connected to each adjacent pair of said treads; and at least one longitudinal slot means formed within one of said linkage members, said slot means located at the pivotal interconnection between a pair of said members, said slot means being inclined with respect to the longitudinal axis of the said member which contains said slot, said slot means permitting an adjusting movement of said framework between a minimum rise adjustment position and a maximum rise adjustment position, said maximum adjustment position being displaced horizontally and vertically from said minimum adjustment position throughout the adjusting movement, the direction of said inclined slot means substantially coinciding with the direction of said adjusting movement, means interconnecting a said stringer and a said tread spacer and a said tread carrier, said means passing through said slot means, said means being movable within said slot means during said adjusting movement.

2. The framework as defined in claim 1 wherein:

said vertical tread spacer connected by said means to said upper stringer establishing a first connection point, said vertical tread spacer connected by said means to said lower stringer establishing a second connection point, during said adjusting movement said first connection point being gradually displaced horizontally and vertically from said second connection point during said adjusting movement.

3. The framework as defined in claim 1 wherein:

during said adjusting movement the amount of said horizontal movement is equal to two-thirds of the amount of said vertical movement.

4. The framework as defined in claim 1 wherein:

said vertical tread spacer being gradually displaced horizontally and vertically during said adjusting movement while maintaining its substantially vertical position.

5. The framework as defined in claim 1 wherein:

said adjusting movement being arcuate, said slot means includes a single curved slot formed within each of said vertical tread spacers, the curvature of said slot substantially coinciding with the curvature of the adjusting movement.

6. The framework as defined in claim 1 wherein:

there being a said upper stringer and a said lower stringer located on each said lateral side of said treads, on each side lateral side said upper stringer being substantially parallel with said lower stringer, however, during the adjusting movement the distance between a said upper stringer and the respective said lower stringer will vary.

7. The framework as defined in claim 6 wherein:

each of said upper stringers being parallel and in transverse alignment with respect to each other.

8. The framework as defined in claim 7 wherein:

each said lower stringers being parallel and in transverse alignment with respect to each other.

9. The framework as defined in claim 8 wherein:

each said upper stringer pivotally connected to said tread carriers adjacent said front side of said treads, each of said lower stringers pivotally connected to said rear side of said treads.

10. The framework as defined in claim 1 wherein:

said slot means includes a single longitudinal straight slot formed within each of said vertical tread spacers.

11. The framework as defined in claim 10 wherein:

said adjusting movement being slightly arcuate, said straight slot being oversized in width in respect to said means, said straight slot being constant in width, whereby said means is permitted to move in a slight arc within said straight slot.

12. The framework as defined in claim 1 wherein:

said slot being lineal and having a longitudinal center axis, said adjusting movement being arcuate defining a movement axis, said longitudinal center axis of said slot substantially coinciding with said movement axis.

13. The framework as defined in claim 12 wherein:

said movement axis being tangent to said longitudinal center axis.

14. The framework as defined in claim 12 wherein:

said longitudinal center axis intersecting said movement axis.

15. The framework as defined in claim 12 wherein:

said movement axis being spaced from said longitudinal center axis.

* * * * *

UNITED STATES PATENT OFFICE

CERTIFICATE OF CORRECTION

Patent No. 3,962,838 Dated June 15, 1976

Inventor(s) Joe Warren Cox

It is certified that error appears in the above-identified patent and that said Letters Patent are hereby corrected as shown below:

The title of the patent, item 54 and at the beginning of Column 1 is in error and should read ---SELF-ADJUSTING STAIR---.

Signed and Sealed this

Thirty-first Day of August 1976

[SEAL]

*Attest:*

RUTH C. MASON
*Attesting Officer*

C. MARSHALL DANN
*Commissioner of Patents and Trademarks*